US008166912B2

(12) United States Patent
Ko

(10) Patent No.: US 8,166,912 B2
(45) Date of Patent: May 1, 2012

(54) POWDER SPRAY COATING DISCHARGE ASSEMBLY

(75) Inventor: Man Kin Mickey Ko, Central (HK)

(73) Assignee: Yu Tung Investment Holdings Limited, Central (HK)

( * ) Notice: Subject to any disclaimer, the term of this patent is extended or adjusted under 35 U.S.C. 154(b) by 231 days.

(21) Appl. No.: 12/411,841

(22) Filed: Mar. 26, 2009

(65) Prior Publication Data

US 2009/0229517 A1 Sep. 17, 2009

Related U.S. Application Data

(63) Continuation of application No. PCT/GB2007/050518, filed on Aug. 31, 2007.

(51) Int. Cl.
*B05B 5/025* (2006.01)
*B05B 5/00* (2006.01)
*B05C 19/00* (2006.01)

(52) U.S. Cl. ..... 118/629; 118/625; 118/671; 118/308

(58) Field of Classification Search ..... 118/308, 118/620–640, 671, 712, 695–697; 239/691, 239/704, 708; 427/475, 458, 180, 8, 9; 324/452
See application file for complete search history.

(56) References Cited

U.S. PATENT DOCUMENTS 4,011,991 A * 3/1977 Masuda ..... 239/708
5,908,162 A 6/1999 Klein et al.
6,274,202 B1 8/2001 Campbell

FOREIGN PATENT DOCUMENTS

EP 0574305 A1 12/1993
EP 1800757 A1 6/2007
WO 2006030991 A1 3/2006

OTHER PUBLICATIONS

International Search Report Dated Apr. 12, 2007 issued in related PCT Application No. PCT/GB2007/050518.

* cited by examiner

*Primary Examiner* — Yewebdar Tadesse
(74) *Attorney, Agent, or Firm* — Ronald E. Prass, Jr.; Prass LLP

(57) ABSTRACT

A powder spray coating discharge assembly (230, 260, 216, 228, 232) for connection to an electrostatic spray coating gun (210), the gun (210) having a gun body (212), means for connecting to a supply of coating powder and means for supplying a voltage (20) at first and second potentials respectively to first (292) and second electrical connections (294) each for connection to a respective one of a discharge electrode (232) and a counter electrode (260), the means for supplying the voltage (20) comprising: a variable voltage power supply (114) having an input connected to an electrical power source (110), an output connected to each of the first and second electrical connections (292, 294), a control circuit (128) for controlling the variable voltage power supply (20) and means (120) for sensing an output load, wherein the control circuit (128) is adapted to adjust the variable voltage power supply (20) to reduce the voltage and current in proportion to a sensed increase in load, or vice-versa.

19 Claims, 11 Drawing Sheets

POWDER SPRAY COATING DISCHARGE ASSEMBLY

CROSS REFERENCE TO RELATED APPLICATION

This application is a National Stage entry of International Application No. PCT/GB2007/050518, filed Aug. 31, 2007, the entire specification, claims and drawings of which are incorporated herewith by reference.

BACKGROUND

1. Field of the Invention

This invention relates to electrostatic powder spray coating apparatus, and in particular, but not exclusively, to electrode arrangements for electrostatic powder spray coating apparatus.

2. Introduction

Electrostatic powder spray coating apparatus can be used for depositing powder coatings on substrates. A known electrostatic powder spray coating apparatus generally comprises a nozzle through which powder can be sprayed and a discharge electrode located adjacent to the nozzle. The discharge electrode is maintained at an elevated electrical potential with respect to a grounded workpiece so that an electromagnetic field is created between the discharge electrode and the workpiece. As the powder passes through the field, it becomes charged, so that it is attracted to, and adheres to, the workpiece.

Electrostatic spray guns of the corona discharge type operate by the discharge of a very high DC voltage, typically between 30 to 100 kV. This high voltage at the discharge electrode or electrodes results in a discharge current which creates ionized air through which the sprayed powder passes as it is conveyed in an air stream to the earthed product to be coated. As the powder passes through the ionized air some charge is transferred from the ionized air to the powder and this causes the powder to be attracted to anything at a lower potential, for example the earthed product.

There are 3 commonly recognized drawbacks with this method of charging, namely "Faraday cages", "back ionisation" and "orange peel".

A Faraday cage is where the charged powder follows the electrostatic lines of force between the discharge electrode and the earthed work piece. These lines of force can be beneficial to create a wrap around effect and coat areas of the product which face away from the spray gun e.g. back surfaces, but they can cause a problem when coating into recesses as the lines of force are established to the outer edges of recesses and will not penetrate inside. This can make it very difficult to coat the inside of such recesses.

Back ionisation is where the excess charge from the ionized air is entrapped into the powder layer deposited onto the surface of the product, and as the charge is all of the same polarity, repulsion effects can cause charge concentrations particularly in thicker coatings, which can erupt from the deposited powder layer to leave holes and craters in the finished and cured powder film.

Orange peel is where the finished cured powder film has an uneven rippled effect like a fine hammer finish. This is believed to be caused largely by excess charge from the ionized air being attracted to the surface of the deposited powder and when the powder melts during the curing process, this excess charge is drawn towards the surface of the substrate causing indentations in the finished powder film.

In summary, the known arrangement has the disadvantage that that the nature, i.e. the strength and distribution, of the field depends largely on the geometry of the workpiece and the proximity of the discharge electrode to the workpiece. Where the workpiece has a complex shape such as sharp edges, undercuts etc., the field tends to concentrate at those regions, which can give rise to preferential coating, and hence, an uneven coating thickness in those areas. The field lines are also established strongly between the discharge electrode and the external edges of recesses thus creating "Faraday Cages" within the recesses which are notoriously difficult to coat as the field is weak or non existent within deep recesses.

In order to charge the coating powder effectively, significantly more charge is generated by the discharge electrode in terms of free ions than is actually required to charge the powder. These free ions are attracted to the earthed workpiece and although most are "neutralised" by the contact with earth, a significant quantity become entrapped in the powder layer or remain on the surface of the powder layer insulated from earth by the powder and can give rise to graters or holes in the finished powder film or an "orange peel" effect on the finished surface.

There are various ways in which these 3 problems can be minimized, for example the operator can make continual adjustment to the discharge voltage and/or discharge current to suit the distance of the gun to the product and the type of product/powder being sprayed. This is not very practical on a busy production line.

Many spray guns/control systems have pre-selected settings of charge for different types of product, e.g. flat sheets; complex parts with Faraday Cages or Recoating where an insulating powder film already exists on the product. Although this can be useful, most products do not fall simply into one category and to change presets while spraying one part or between many different parts is also not very practical.

Many spray guns/control systems now operate with "Constant Current" circuits whereby the discharge current will rise as the spray gun approaches the earthed product but only to a preset value. If the gun is taken closer, the discharge voltage will automatically reduce progressively which reduces the overall charge as the gun approaches the product. Although this helps, it is the current which represents the amount of free ions or ionized air and this does not reduce as the gun distance reduces.

One system which addresses this is described in U.S. Pat. No. 6,274,202 whereby the discharge current as well as the discharge voltage, reduce as the spray gun approaches the product.

One method which has been used with some success is to locate the discharge electrode and an earthed counter electrode within the body or the nozzle of the spray gun. This generates minimal ionized air and contains the electrostatic lines of force within the spray gun. It is, however very difficult to prevent the counter electrode from becoming contaminated with powder and therefore ineffective after a short while.

The internal charging nozzle mentioned above can be turned inside out with an earthed counter electrode fitted outside and behind a conventional corona charging nozzle. This counter electrode can take the form of a single earthed metal rod or pin electrode or can be a series of earthed pins in an annular array either pointing forward towards the nozzle or tangentially out from the nozzle. This is usually an "add on" offered by many spray gun manufacturers and is usually used to achieve a good high quality, smooth finish. In general the charging of the powder is slower and less efficient. The counter electrode is usually mounted approximately 100 mm.

behind the discharge electrode in an attempt to keep the discharge voltage at a maximum. This system will cease to be effective if the nozzle (discharge electrode) is taken closer to the product than the distance between the discharge electrode and the counter electrode, say 100 mm, as is often the case when spraying by hand. Another drawback with this method is that the discharge current is usually very high, typically around 100 μA which can cause powder to fuse onto the corona discharge needle due to the hot corona "glow" at the discharge point, this will reduce the charging efficiency and can lead to sparking due to capacitive discharge. Although in many cases the operator will be able to limit the maximum discharge current from the control system, this will invariably not happen as it tends to be the inclination of most operators to turn controls to maximum in an attempt to improve productivity. Another problem with running maximum Discharge voltage and current continuously is that more consideration must be given to the reliability of the highly stressed high voltage components and also the heat generated by the electronic parts of the spray gun.

SUMMARY OF THE INVENTION

It is an object of this invention to address one or more of the above problems and/or to provide an improved electrostatic powder spray coating apparatus.

A first aspect of the invention provides a powder spray coating discharge assembly for connection to an electrostatic spray coating gun, the gun having a gun body, means for connecting to a supply of coating powder and means for supplying a voltage at first and second potentials respectively to first and second electrical connections each for connection to a respective one of a discharge electrode and a counter electrode, the means for supplying the voltage comprising: a variable voltage power supply having an input connected to an electrical power source, an output connected to each of the first and second electrical connections, a control circuit for controlling the variable voltage power supply and means for sensing an output load, wherein the control circuit is adapted to adjust the variable voltage power supply to reduce the voltage and current as a function of a sensed increase in load, or vice-versa.

Preferably, the control circuit is adapted to adjust the variable voltage power supply to reduce the voltage and current in proportion to a sensed increase in load, or vice-versa.

The invention preferably enables the automatic setting of charging parameters when using a counter electrode, such that the charge is automatically set as a function of distance between the counter and discharge electrodes. Since the charging parameters can be made to depend on the load, the charging parameters can be varied automatically to compensate for transient changes, such as fluctuations in the powder throughput, atmospheric conditions etc.

A second aspect of the invention provides a powder spray coating discharge assembly for connection to an electrostatic spray coating gun, the gun having a gun body, means for connecting to a supply of coating powder and means for supplying a voltage at first and second potentials respectively to first and second electrical connections each for connection to a respective one of a discharge electrode and a counter electrode, the assembly comprising: an electrically insulating spacer having means for connecting to a gun body, and a conduit for the passage of coating powder; a nozzle having means for connecting to the spacer and having an aperture for the discharge of coating powder; a discharge electrode located downstream of the discharge aperture of the nozzle and electrically connectable one of the first or second electrical connections; and a counter electrode located between the discharge electrode and the portion of the spacer which is adapted to engage the gun body, the counter electrode being electrically connectable to the other of the first and second connections.

A third aspect of the invention provides an electrostatic powder spray coating apparatus comprising a gun having a body, an electrically insulating spacer connectable to the body, a nozzle connectable to the spacer through which a stream of powder is sprayable, a discharge electrode located downstream of the nozzle, and a counter electrode between the nozzle and the body-spacer interface.

A fourth aspect of the invention provides an electrostatic powder spray coating system comprising at least one electrostatic powder spray coating gun comprising a body, an electrically insulating spacer connected to the body, a nozzle connected to the spacer through which a stream of powder is sprayable, a discharge electrode located downstream of the nozzle, and a counter electrode located upstream of the nozzle, the counter electrode being positioned downstream of the body-spacer interface, and at least one user interface.

A fifth aspect of the invention provides a powder spray coating discharge assembly for connection to an electrostatic spray coating gun, the gun having a gun body, means for connecting to a supply of coating powder and means for supplying a voltage at first and second potentials respectively to first and second electrical connections each for connection to a respective one of a discharge electrode and a counter electrode, the assembly comprising: an electrically insulating spacer having means for connecting to a gun body, and a conduit for the passage of coating powder; a nozzle having means for connecting to the spacer and having an aperture for the discharge of coating powder; a discharge electrode located downstream of the discharge aperture of the nozzle and electrically connectable to the first electrical connection; and a counter electrode located externally of the spacer, the counter electrode being electrically connectable to the second electrical connection; wherein the means for supplying a voltage at first and second potentials comprises a control circuit arranged to automatically adjust the discharge voltage and current at the first and/or second electrical connection as a function of any one or more of the group comprising: the distance between the discharge electrode and the counter electrode, the powder throughput, the powder type, the electrode condition and atmospheric conditions.

Surprisingly, it has been observed, when using the present invention, that by setting an external counter electrode in a similar relationship to the discharge electrode of a conventional corona discharge nozzle, but behind the nozzle and relatively close thereto (by 50 mm away), and using similarly low discharge voltage and current (say, 40 kV and 20 μA, respectively) the charging of the powder remains adequate. This runs contrary to conventional wisdom, in which it is believed that a minimum threshold discharge voltage and current are required to cause the powder to charge adequately. Advantageously, by reducing the discharge voltage and current, the three aforementioned problems (Faraday cage, back ionization and orange peel) can be greatly reduced due to the electrostatic field being established to the counter electrode and not to the product, which results in little or no current flowing to or through the product.

Further, by moving the discharge electrode and counter electrode closer together than in conventional counter electrode systems, the system is less likely to be rendered ineffective when the manual spray gun is moved close to the product. By using the much lower discharge voltage and current there is less likelihood of developing fused powder on the discharge electrode due to the corona glow and there will be less stress to the high voltage components and less heating effects to the electronics leading to greater reliability.

A power source is preferably provided for electrically biasing the discharge electrode with respect to the counter electrode.

Preferably, the maximum voltage that the power source can apply to the discharge and/or counter electrode is limited to 100 kV, and more preferably to 70 kV. In a most preferred embodiment of the invention, the maximum voltage that the power source can apply to the discharge and/or counter electrode is limited to 40 kV The discharge current is preferably limited. Preferably, the maximum discharge current at the discharge and/or counter electrode is less than 100 μA, and preferably less than 70 μA. In a most preferred embodiment, the maximum discharge current at the discharge and/or counter electrode is substantially 20 μA.

Preferably, the counter electrode is positioned between the nozzle and the spacer.

Positioning the counter electrode so close to the discharge electrode is contraindicated by the prior art, since it is believed that the high voltage required to create a sufficient field to charge the powder cannot be maintained between closely spaced electrodes without the risk of sparking.

Surprisingly, it has been noted that substantially the same powder charging can be obtained using a less intense field (i.e. with a lower voltage and/or current) if the discharge and counter electrodes are positioned closer together.

In a preferred embodiment the apparatus may further comprise a controller for controlling the voltage and/or current applied to the discharge electrode.

The spacer can be releasably connectable to the body. Preferably, the nozzle and spacer are integrally formed.

The control circuit may comprise one or more user interfaces, which enable a user to set the desired process parameters. Additionally, a power sensing feedback or alternatively circuit, which monitors the actual process parameters and/or adjusts the power supply to compensate for any deviation between the desired and actual parameters is preferably provided.

The power sensing/feedback circuit, where provided, may comprise a voltmeter and/or an ammeter connected to the discharge and/or the counter electrode. The sensed outputs from the volt meter and/or the ammeter can be sent to a microprocessor. The microprocessor, where provided, is preferably configured to monitor and/or log the sensed outputs and/or to perform processing operators in response thereto.

The control circuit may comprise a power controller for varying the output voltage. The power controller may comprise a potential divider, and/or means for varying the current, such as a variable load/resistor.

The controller preferably has various operating modes which can be selected by the user for different coating applications. Such modes may include: constant voltage and/or constant current control, and/or fixed voltage control and/or fixed current control, and/or proportional energy control.

The first mode, fixed voltage control, is where the user moves the discharge electrode far away from the workpiece and/or specifies a nominal operating voltage. The power control circuit adjusts the discharge voltage to the specified parameter and locks it. Thus, in use, as the discharge electrode is moved towards or away from the workpiece, the discharge current rises and falls.

The constant current mode enables the user to set a desired operating current. However, in this modes, the current is allowed to rise to a maximum set value as the gun moves towards an earthed object. When this maximum is reached, it is held at that pre-set value and the voltage is reduced proportionally if the gun is moved yet closer to the earthed object.

Finally, the proportional energy control mode enables the user to specify a desired energy, which corresponds to a desired charge on the powder. Thus, the control module is free to select any discharge voltage and current provided the energy i.e. the product of the voltage and current, remains proportional to the load resistance.

Automatic Energy Control will set the voltage and current levels automatically to optimum settings for the distance between the electrode and counter electrode without the need for operator adjustment.

In any of the above modes, the control circuit can be set to control the voltage/current at the discharge (or counter) electrode with respect to either the counter (or discharge) electrode or the workpiece.

Thus, the control circuit may allow the user to select from a variety of operating modes. Of particular relevance to the invention is proportional energy control with respect to the counter electrode. Additionally, fixed voltage mode with respect to the workpiece, fixed voltage mode with respect to the counter electrode, fixed current mode with respect to the workpiece, fixed current mode with respect to the counter electrode, constant voltage mode with respect to the workpiece, constant voltage mode with respect to the counter electrode, constant current mode with respect to the workpiece, and constant current mode with respect to the counter electrode, are alternative operating modes.

In all modes, the control circuit preferably provides a safety shut-off that shuts off the power supply in the event of an earth leak, an arc discharge or short circuit.

A user keypad and/or a visual display unit is preferably provided that enables the user to program the control circuit i.e. set the desired operating mode and/or process parameters. A powder delivery means, comprising, for example, hoses, a filter, a fluidising bed and a pump is preferably provided to deliver the powder from a powder supply (e.g. a carton of dry powder) to the nozzle of the gun during use.

The powder spray discharge coating assembly according to the fourth aspect of the invention automatically adjusts the discharge voltage and/or current at the discharge and/or counter electrode. Since higher powder quantities/throughputs have the effect of suppressing the corona discharge, a higher voltage for the same electrostatic energy would preferably be applied to the discharge and/or counter electrode. Different powder types may require different discharge voltages and/or currents to achieve sufficient charging, depending on the surface area/powder particle, the powder material, surface roughness etc. Thus, the discharge voltage and/or current is preferably adjustable to compensate for these variations. As the discharge or counter electrode degrades with use (e.g. by wear, attrition, oxidation, thermal cycling etc.) the applied discharge voltage and/or current is preferably automatically adjusted to compensate. Atmospheric conditions, such as temperature, humidity etc may affect the powder charging (e.g. higher humidity will lead to a reduced discharge current for a given discharge voltage since the conductivity of the air will be increased). Accordingly, it is a preferred feature of the invention that the discharge voltage and/or current be adjustable, preferably automatically, to compensate for these variations.

DESCRIPTION OF THE PREFERRED EMBODIMENTS

Figure 1:
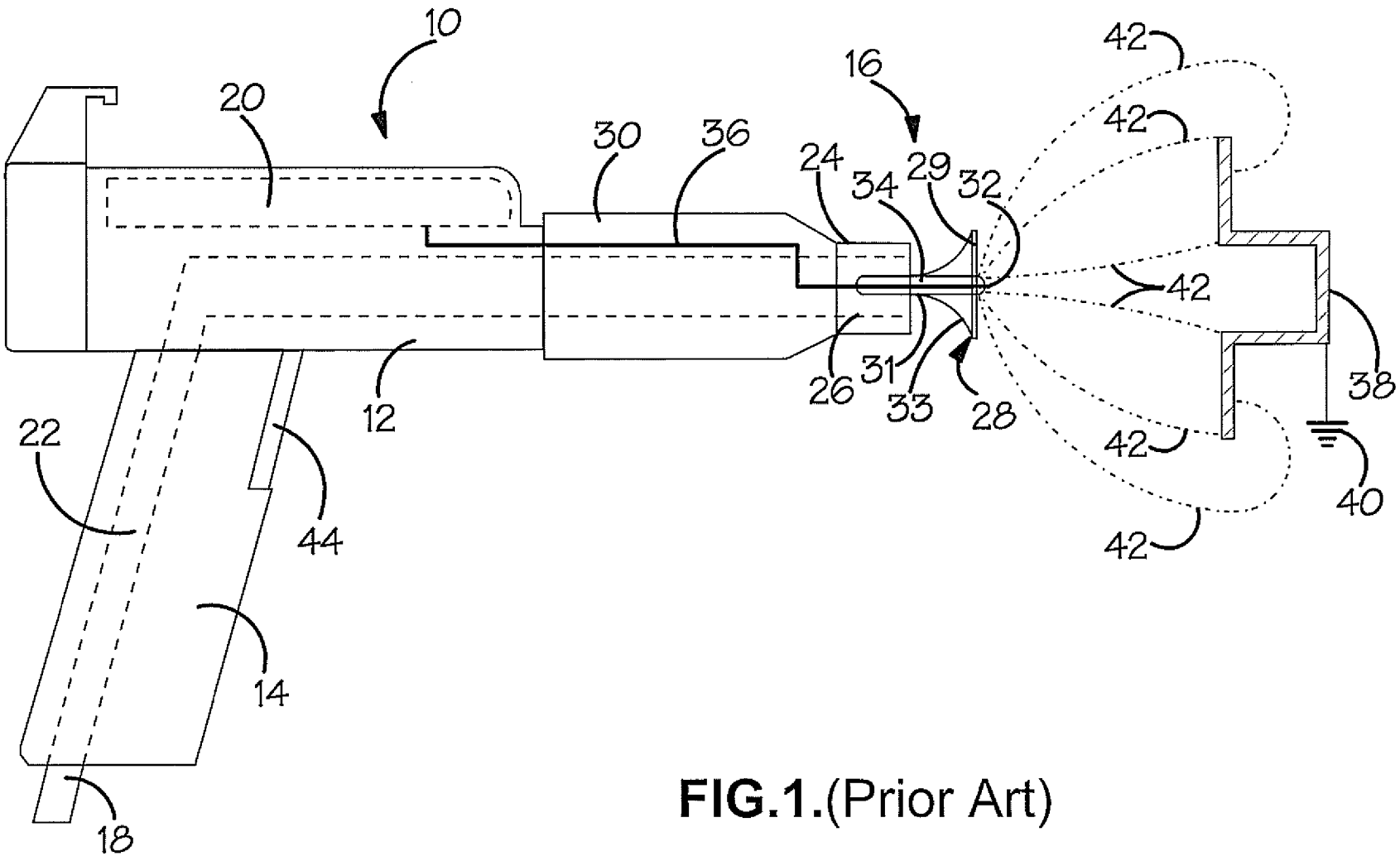
FIG.1.(Prior Art)
FIG. 1 is a side view of a prior art electrostatic powder spray coating gun.

A prior art electrostatic powder spray gun 10 is shown in FIG. 1, which generally comprises a body 12, a grip 14 and a nozzle 16. At the bottom of the grip 14, there is a connector 18 for connecting the gun 10 to a hose (not shown) that supplies powder thereto and to a mains power supply. An upper part of the body 12 houses a power supply unit 20, which outputs a high voltage (positive or negative) from the incoming electrical power. Inside the body 10, a conduit 22 internally connects the hose connector 18 to the nozzle 16.

Interposed between the nozzle 16 and the body 12 is an electrically insulating annular spacing sleeve 30, known as a "nozzle nut". The spacing sleeve 30 is detachable from the body 12.

The nozzle 16 comprises an annular plastics sleeve portion 24, whose aperture 26 is aligned with an end of the conduit 22. Concentrically aligned with, and protruding partially into, the aperture 26 is a deflector 28. The deflector 28 has a generally flat, circular front face 29 and a generally cylindrical shaft 31 extending rearwards therefrom with a semi-hyperboloidal rear surface portion 33 forming a flared blend between the shaft 31 and the front face 29. Thus, powder enters the gun 10 via the hose connector 18, travels through the conduit 22 and exits the gun at the nozzle 16. The deflector 28 causes the trajectory of the powder particles to be deflected outwardly, which creates, in this case, a generally conical spray in front of the nozzle 16.

The nozzle 16 is integrally formed with the spacing sleeve 30 and, hence, can be interchanged with other nozzles having differently profiled deflectors (by replacing the spacer-nozzle assembly) to obtain different spray patterns. (For example, a nozzle having no or a very small deflector could create a substantially cylindrical jet of powder, or a deflector comprising a slotted aperture could create a rectangular spray pattern.)

A discharge electrode 32, in the form of a wire, passes through the deflector 28 and protrudes beyond the front face thereof. The discharge electrode passes through an annular plastics bush 34, to insulate the discharge electrode 32 from the deflector 28. A wire 36 connects the discharge electrode 32 to the power supply 20.

Since the discharge electrode 32 is fully insulated from the remainder of the nozzle 16 (by virtue of the plastics bush 34, the plastics annular portion 24 of the nozzle and the plastics spacing sleeve 30), it can be maintained at a desired electrical potential with respect to the rest of the gun 10.

In FIG. 1, a workpiece 38 placed in front of the gun 30 and is connected to ground 40. An electrical field is therefore created between the discharge electrode 32 and the workpiece 38, which is represented by chain-dot lines 42 in FIG. 1.

Finally, a trigger 44 is provided on the grip 14 of the gun 10 so that an operator can start or stop the spray coating process as desired.

Figure 2:
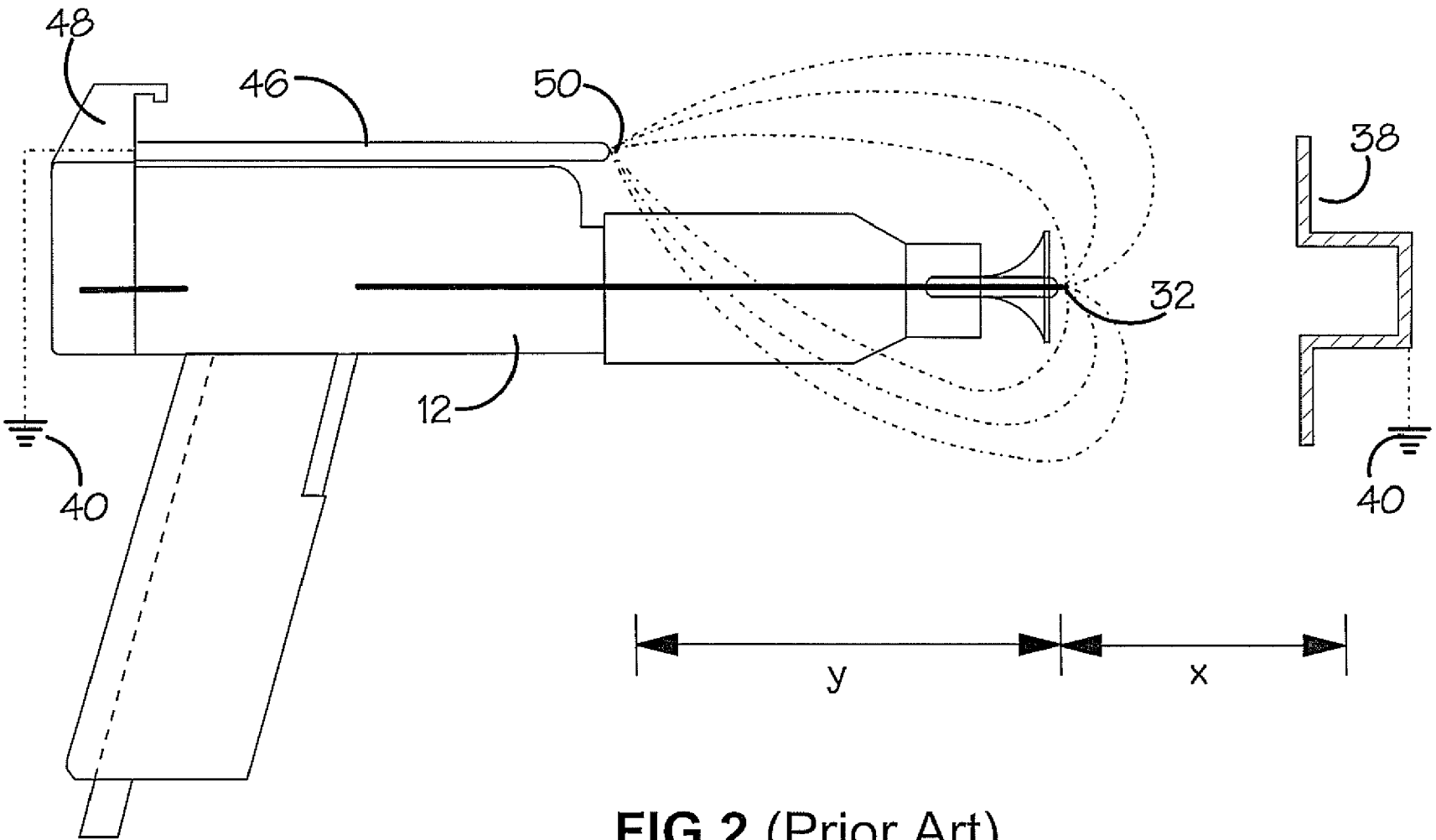
FIG.2.(Prior Art)
FIG. 2 is a side view of a variant of the prior art electrostatic powder spray coating gun of FIG. 1 comprising a counter electrode.
Figure 3:
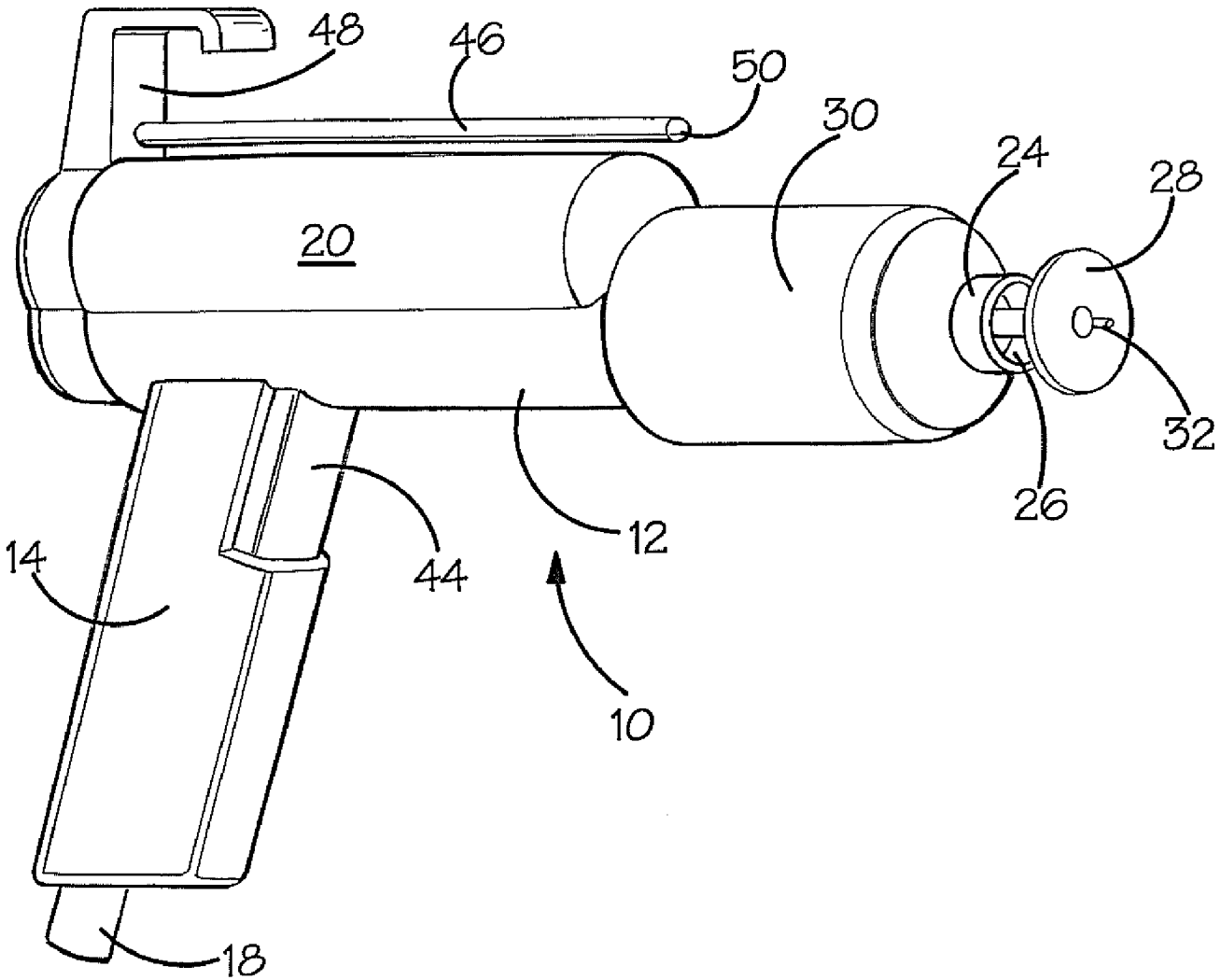
FIG.3.(Prior Art)
FIG. 3 is a perspective view of the prior art electrostatic powder spray coating gun of FIG. 2.

Another known setup is shown schematically in FIGS. 2 and 3, which is generally the same as the arrangement as that shown in FIG. 1, except with the addition of a counter electrode 46. The counter electrode 46 comprises a straight solid metal rod that is supported at its rear end remoter from the nozzle 16, by passing through an aperture in a plastics support piece 48 which protrudes above the top of the body 12 of the gun 10. The front end of the counter electrode 46 extends to a position towards the front of the body 12 of the gun 10 adjacent to the rear end of the spacing sleeve 30. The counter electrode 46 is connected to ground 40 so that the electrical field 42 preferentially extends backwards from the discharge electrode 32 to the counter electrode 46, rather than forwards, towards the workpiece 38. When the gun 10 is at relatively large spacings from the workpiece 38, i.e. when the discharge electrode-workpiece spacing is greater than the discharge electrode-counter electrode tip 50 spacing (if $x>y$) then the field will generally extend from the discharge electrode 32 to the counter electrode tip 50. However, since the electric field will normally try to take the "path of least resistance", when the gun 10 is moved towards the workpiece 38, (i.e. so that $x<y$) then the field may preferentially ground to the workpiece 38, rather than to the counter electrode 46.

Figure 4:
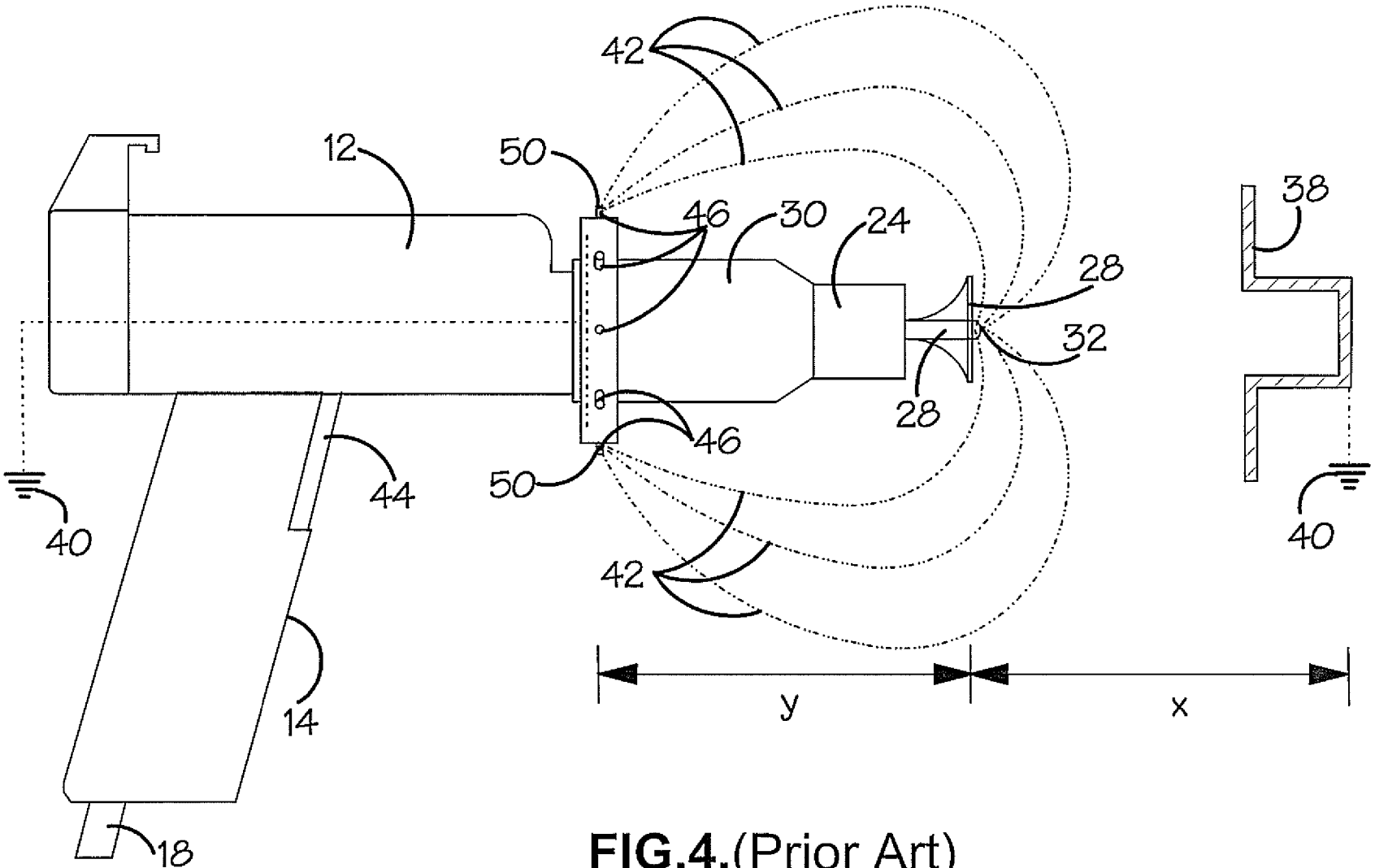
FIG.4.(Prior Art)
FIG. 4 is a side view of another variant of the prior art electrostatic powder spray coating gun of FIG. 1 comprising a plurality of counter electrodes.
Figure 5:
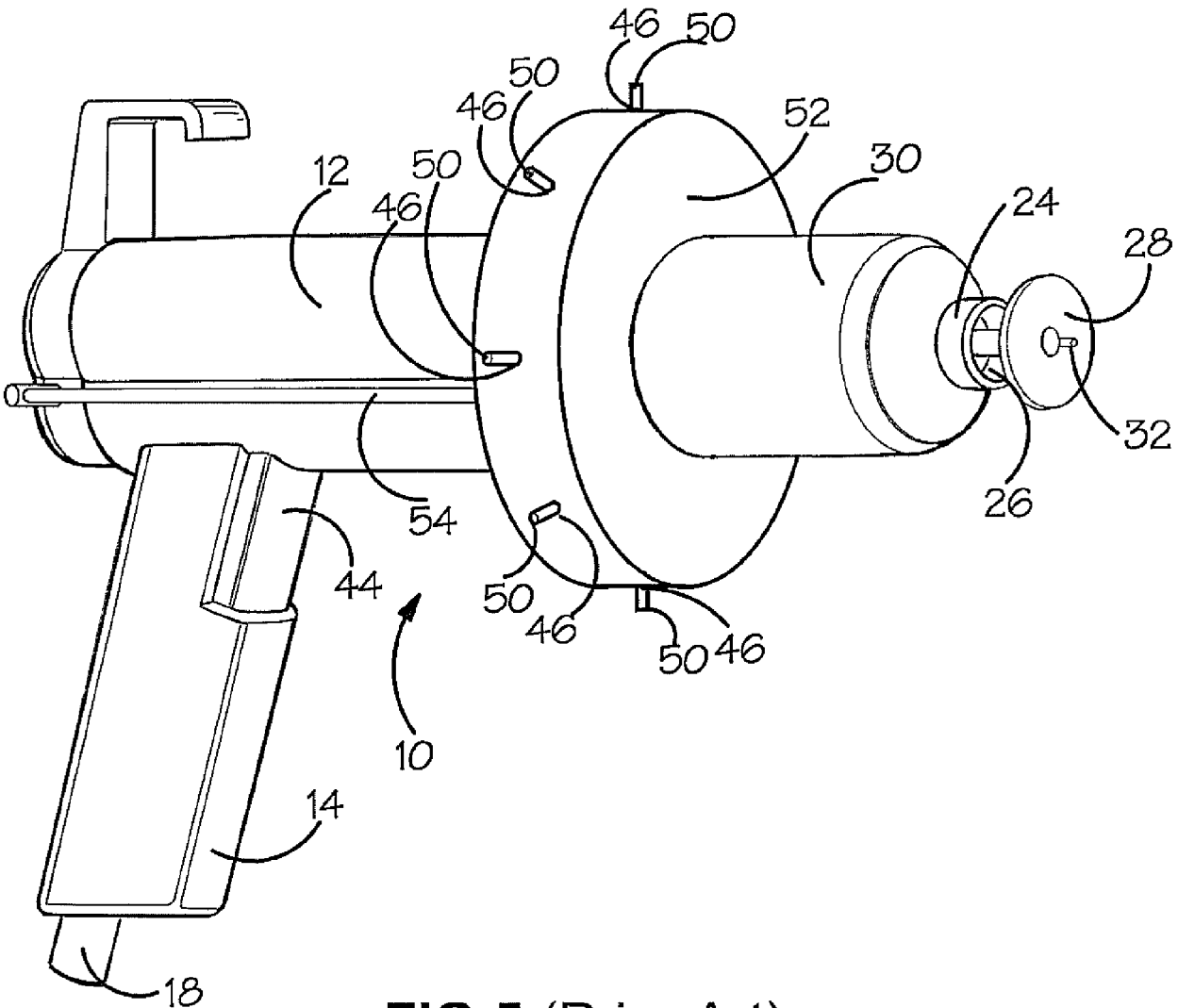
FIG.5.(Prior Art)
FIG. 5 is a perspective view of the prior art electrostatic powder spray coating gun of FIG. 4.

FIGS. 4 and 5 show a variant of the gun shown in FIGS. 2 and 3 in which the counter electrode comprises eight metal pins 46 protruding radially from an annular plastics ring 52. A metal rod 54 and wires (not shown) inside the annular ring 52 serve to electrically connect the counter electrode pins 46 to ground 40.

Preferred embodiments of the invention shall be described, by way of example only, with reference to FIGS. 6 to 10 of the accompanying drawings.

Figure 6:
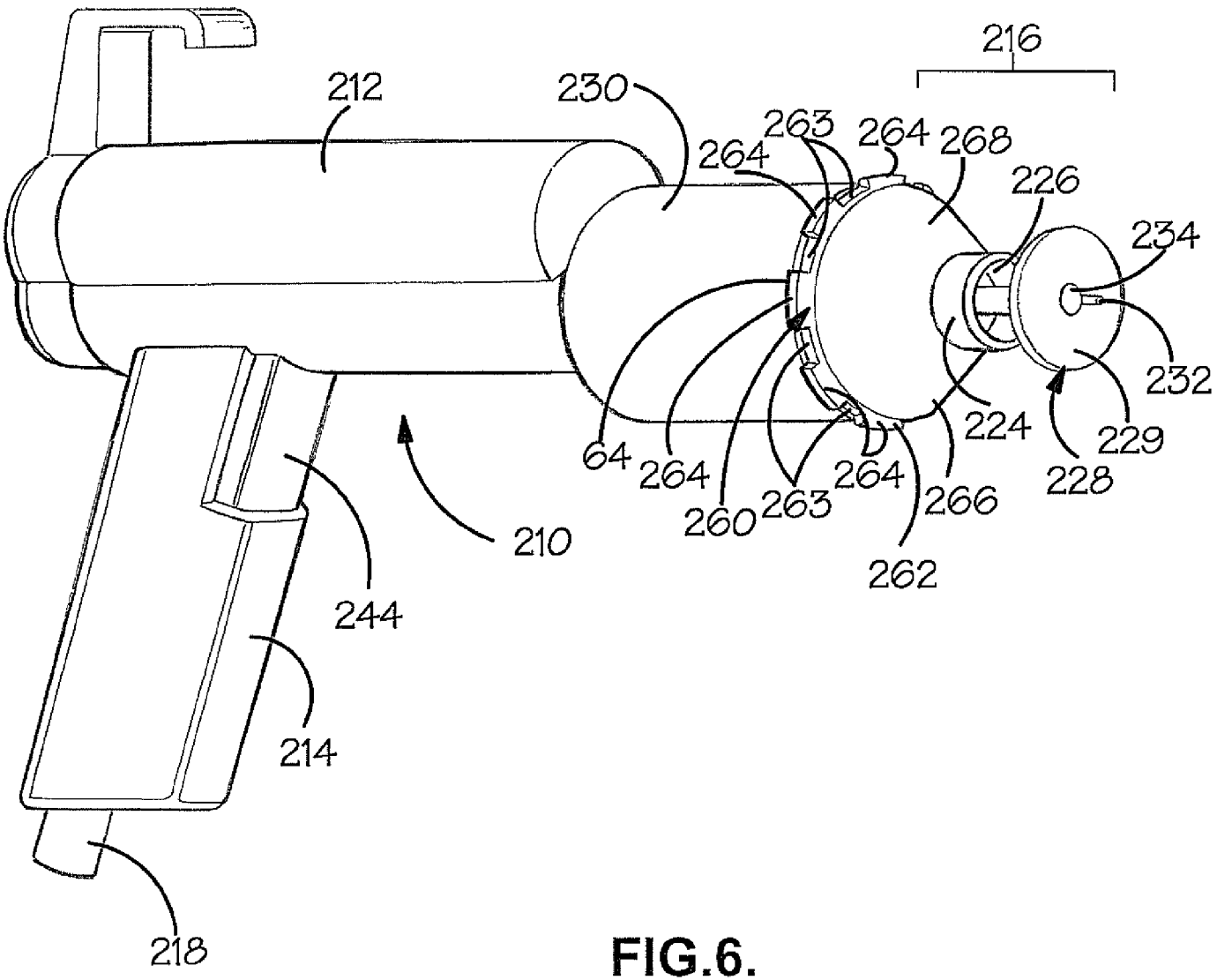
FIG. 6 is a perspective view of an electrostatic powder spray coating gun in accordance with the invention.
Figure 7:
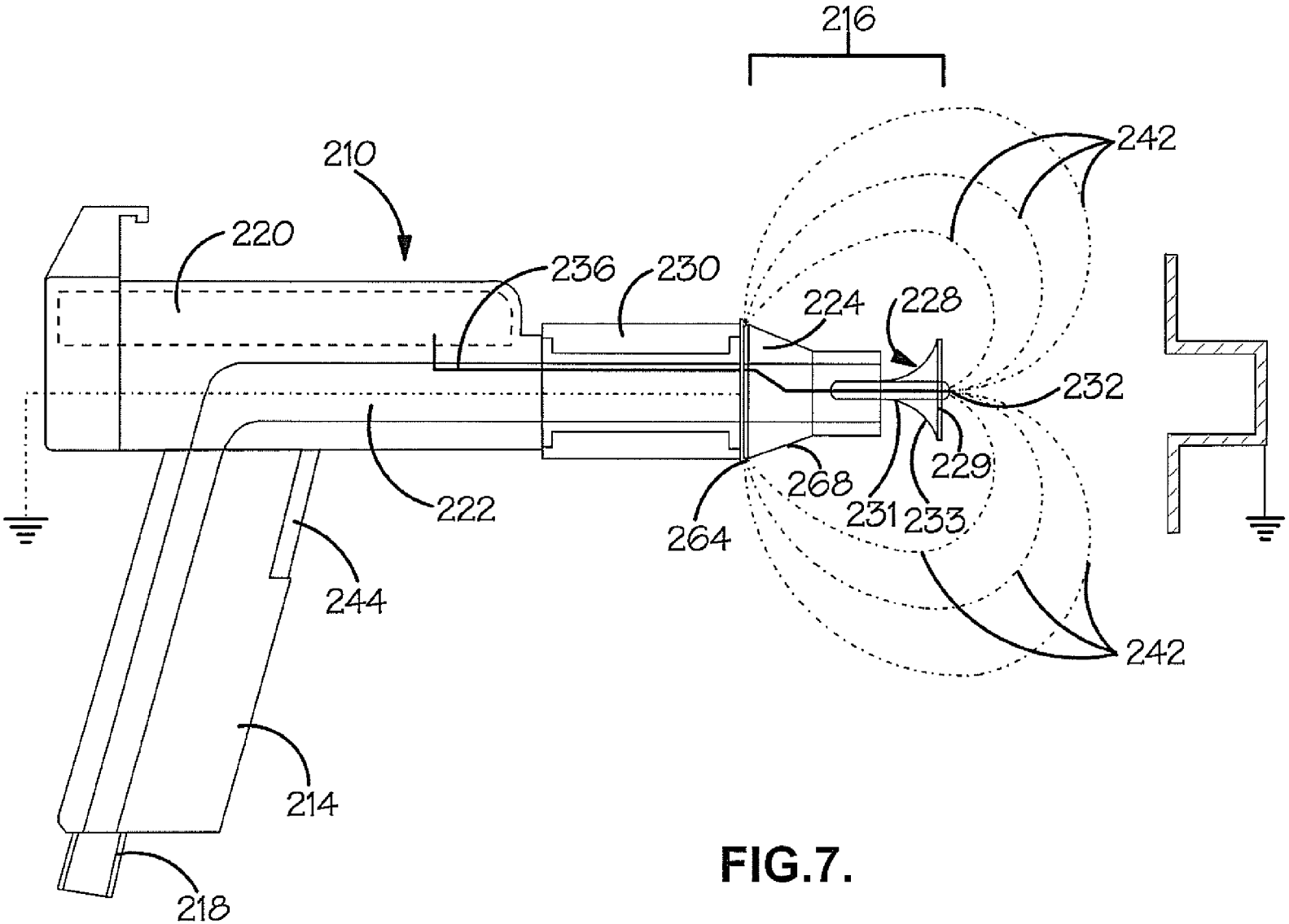
FIG. 7 is a side view of electrostatic powder spray gun of FIG. 6.

An electrostatic spray coating gun 10 according to the invention is shown in FIGS. 6 and 7, which generally comprises a body 212, a grip 214 and a nozzle 216. At the bottom of the grip 214, there is a connector 218 for connecting the gun 210 to a hose (not shown) that supplies powder thereto and to a mains power supply. An upper part of the body 212 houses a power supply unit 220, which outputs a high voltage (positive or negative) from the incoming electrical power. Inside the body 210, a conduit 222 internally connects the hose connector 218 to the nozzle 216.

Interposed between the nozzle 216 and the body 212 is an electrically insulating annular spacing sleeve 230, known as a "nozzle nut". The spacing sleeve 230 is detachable from the body 212.

The nozzle 216 comprises an annular plastics sleeve portion 224, whose aperture 226 is aligned with an end of the conduit 222. Concentrically aligned with, and protruding partially into, the aperture 226 is a deflector 228. The deflector 228 has a generally flat, circular front face 229 and a generally cylindrical shaft 231 extending rearwards therefrom with a semi-hyperboloidal rear surface portion 233 forming a flared blend between the shaft 231 and the front face 229. Thus, powder enters the gun 210 via the hose connector 218, travels through the conduit 222 and exits the gun at the nozzle 216. The deflector 228 causes the trajectory of the powder particles to be deflected outwardly, which creates, in this case, a generally conical spray in front of the nozzle 216.

The nozzle 216 is integrally formed with the spacing sleeve 230 and, hence, can be interchanged with other nozzles having differently profiled deflectors (by replacing the spacer-nozzle assembly) to obtain different spray patterns. (For example, a nozzle having no or a very small deflector could create a substantially cylindrical jet of powder, or a deflector comprising a slotted aperture could create a rectangular spray pattern.)

A discharge electrode 232, in the form of a wire, passes through the deflector 228 and protrudes beyond the front face 229 thereof. The discharge electrode 232 passes through an annular plastics bush 234, to insulate the discharge electrode 232 from the deflector 228. An internal wire 236 connects the discharge electrode 232 to the power supply 220.

Since the discharge electrode 232 is fully insulated from the remainder of the nozzle 216 (by virtue of the plastics bush 234, the plastics annular portion 224 of the nozzle and the plastics spacing sleeve 230), it can be maintained at a desired electrical potential with respect to the rest of the gun 210.

A trigger 244 is provided on the grip 214 of the gun 210 so that an operator can start or stop the spray coating process as desired.

The counter electrode 260 is located between the spacing sleeve 230 and the nozzle 216. The counter electrode 260 comprises an annular metal ring 262 having a castellated periphery comprising a plurality of identical outwardly projecting castellations 264 separated by identical recesses 263. Each castellation 264 protrudes radially beyond the periphery 266 of a conical portion 268 of the nozzle 216. The castellated ring 262 is clamped between the spacing sleeve 230 and the nozzle 216.

As can be seen more clearly in FIG. 7, in use, the electrical field (shown by chain-dot lines 242) emanates from the tip of the discharge electrode 232 and extends backwards towards the castellations 264 of the counter electrode 260. Such a configuration gives rise to a higher field density (i.e. more field lines 242 per unit area) in the vicinity of the nozzle 216 than the prior art arrangements. Because the field density is higher, a lower voltage needs to be applied, compared to the prior art arrangements to achieve comparable powder charging (i.e. transfer of electrons to the powder particles).

Figure 8:
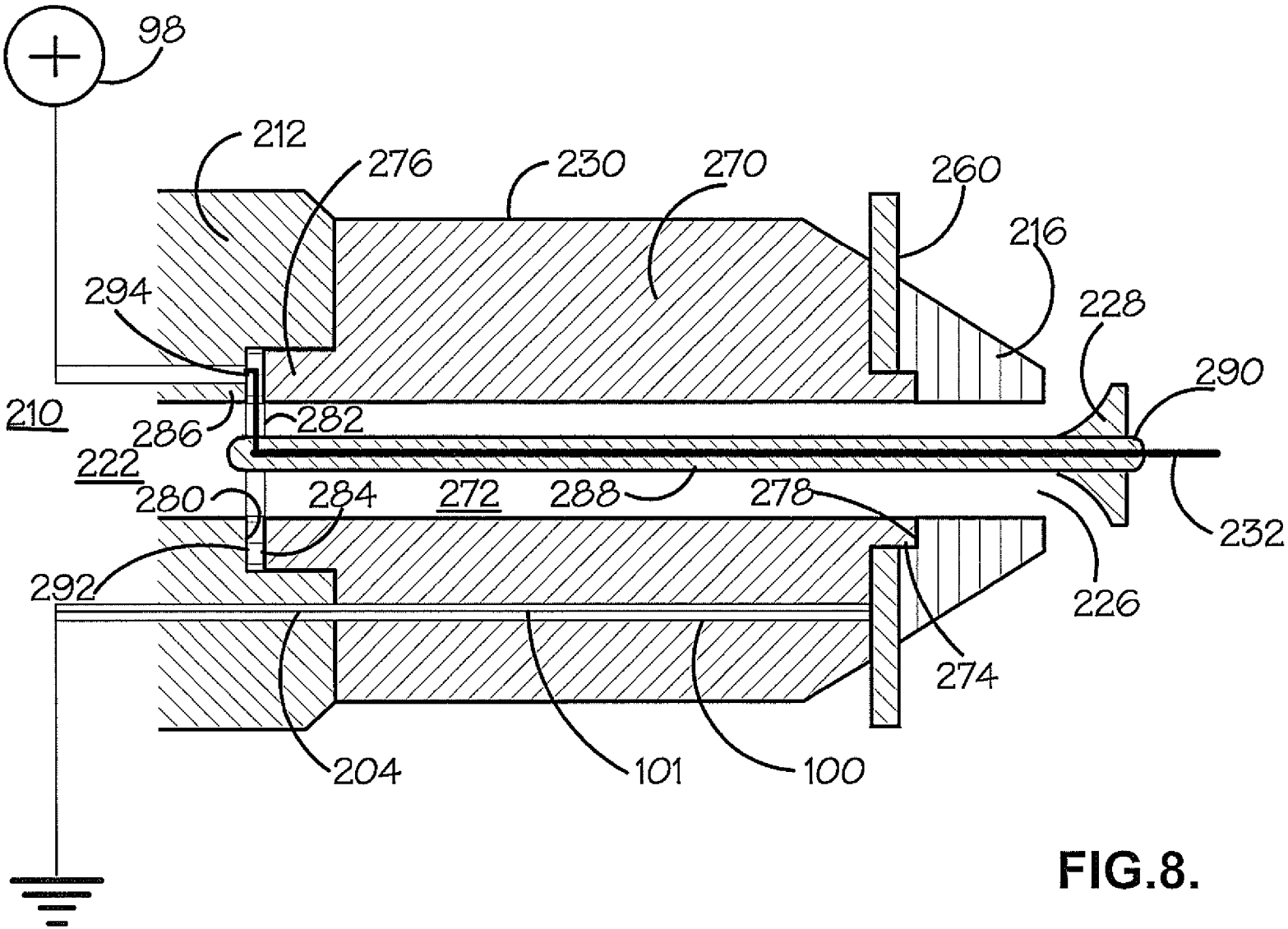
FIG. 8 is a longitudinal cross-section showing a first possible internal configuration of the nozzle and spacer of FIG. 7 on A-A.

FIG. 8 shows a spacer-nozzle arrangement of FIGS. 6 and 7 in greater detail. As can be seen in FIG. 8, the tubular spacing sleeve 230 is connected at one end to the body 212 of the electrostatic powder spray gun 210, and at the other end, to the nozzle 16. The annular castellated counter electrode 260 is clamped between the spacing sleeve 230 and the nozzle 216.

The spacing sleeve 230 comprises a thick-walled plastics tube 270 having a through aperture 272 through which, in use, the powder passes. The aperture 272 is also aligned with the conduit 222 that passes through the body 212 of the gun 210. The spacing sleeve 230 has front and rear axial bosses 274 and 276 at either end, that engage corresponding annular recesses 278 and 280 in the body 12 and nozzle 16, respectively. The front boss 274 and nozzle recess 278 are complementarily screw-threaded so that they can be screw-threadedly connected to one another. The rear boss 276 of the spacing sleeve 230 comprises a bayonet-type connector that is receivable in the recess 280 of the body 212 of the spray gun 210. The nozzle 216 also has an annulus 226 that aligns with the annulus 72 of the spacing sleeve 30.

The counter electrode 260 is also provided with a central through aperture that receives the front boss 276 of the spacing sleeve 230 to allow the counter electrode 260 to be clamped between the nozzle 216 and the spacing sleeve 230 when the two are screwed together.

An electrode centraliser 282, in the form of a thin plastics disc, is clamped between the end 284 of the rear boss 276 and a rear wall 286 of the recess 280 when the spacing sleeve 230 is connected to the body 212. The plastics disc has a plurality of through holes to permit flow through of powder in use. Extending forwards from the centre of the centraliser 282 and beyond the nozzle 216 is an elongate plastics shaft 288 arranged concentrically with the through aperture 272. A flared deflector 28 is integrally formed with the front end of the shaft 88.

The shaft 288 has a central bore, which receives the discharge electrode wire 232. The discharge electrode wire 232 protrudes slightly beyond the forward end 290 of the shaft 288 remote from the centraliser 282. The rear end of the discharge electrode wire 232 passes internally through the centraliser 282 and terminates slightly proud of the rear face 292 of the centraliser to form a contact 294. Thus, when the spacing sleeve 230 is correctly connected to the body 212, the discharge electrode wire 232 makes an electrical contact with an output 298 of the power supply.

A counter electrode wire 100 passes through a channel 101 in the spacing sleeve 230 extending parallel to the longitudinal axis of the spacer sleeve 230, and makes electrical contact at its front end with the counter electrode 260 and at its rear end to a ground terminal 204 of the power supply 220 located in the body 212 of the gun 210.

Thus, by having a bayonet-type fitting, and having the discharge and counter electrode contacts (294 and 204) at different radial positions, it is possible to ensure that the electrodes can only be connected the correct way. Also, if the gun 10 is used in conjunction with a conventional spacer-nozzle (i.e. without a forward-mounted counter electrode), then only the discharge electrode wire will make contact with the power supply.

In use, the discharge electrode 232 is electrically biased with respect to the counter electrode using a power supply located within the body of the apparatus.

Figure 9:
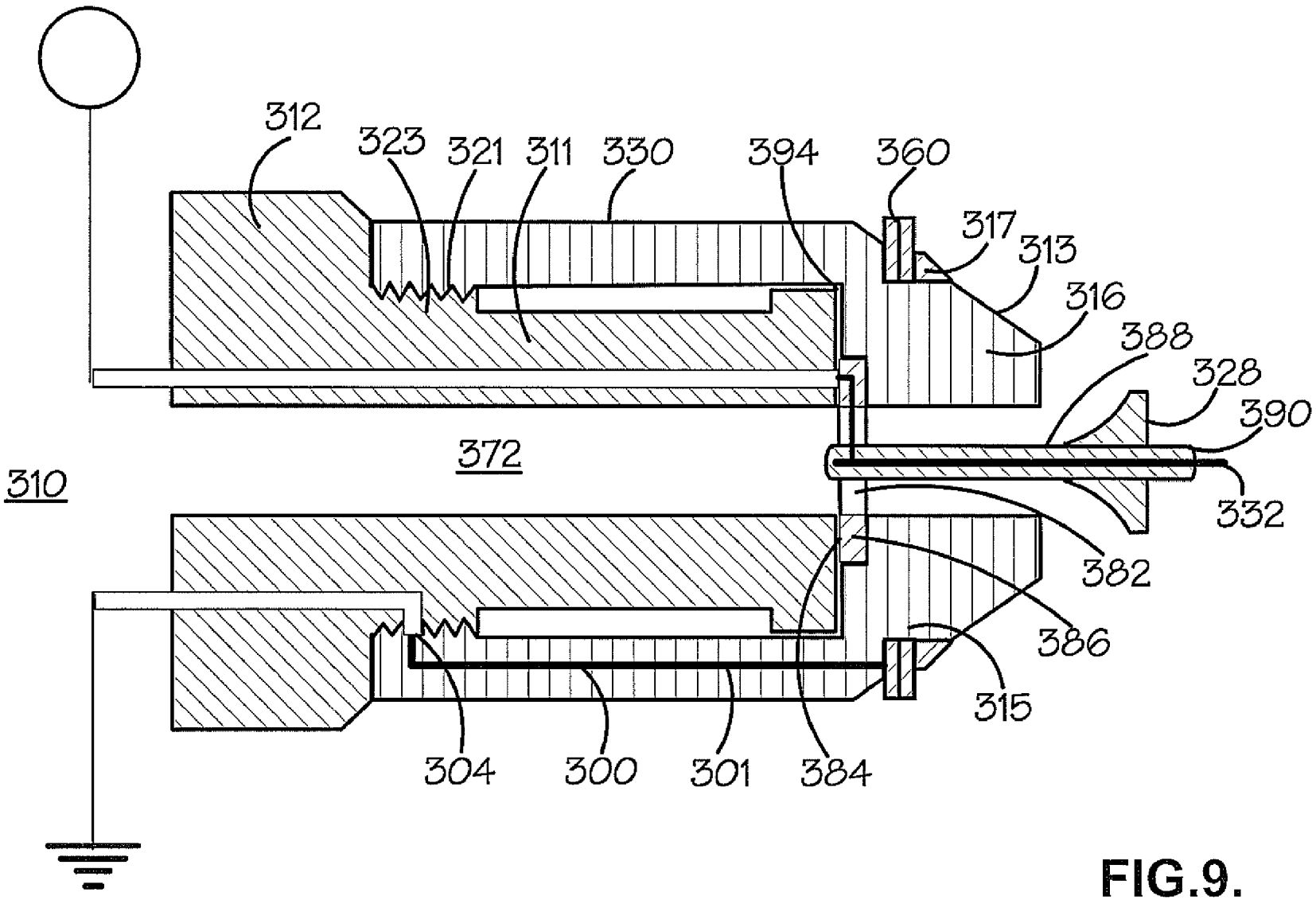
FIG. 9 is a longitudinal cross-section showing a second possible internal configuration of the nozzle and spacer of FIG. 7 on A-A.

FIG. 9 shows a slightly different spacer-nozzle arrangement to that of FIG. 8. As can be seen in FIG. 9, the front end to the body 312 of the electrostatic powder spray gun 310 has a cylindrical extension tube 311 over which the tubular spacing sleeve 330 slides. The nozzle 316, which comprises a part-conical portion 313 and a cylindrical portion 315, is integrally formed with the spacing sleeve 330. A cylindrical aperture 372, which extends through the body 312 aligns with an aperture in the nozzle 316 to allow coating powder to be blown therethrough, in use. An annular castellated counter electrode 360 is clamped onto the cylindrical portion 315 of the nozzle 316 using a screw-threaded locking ring 317.

The spacing sleeve 230 has an internal screw thread 321 at its rear end, which engages a corresponding external screw thread on the outer surface of the cylindrical extension tube 311 so that they can be screw-threadedly connected to one another.

An electrode centraliser 382, in the form of a thin plastics disc, is clamped between the end 384 of the extension tube 311 and a rear wall 386 of the nozzle 316 when the spacing sleeve 330 is connected to the body 312. The plastics disc has a plurality of through holes to permit flow through of powder in use. Extending forwards from the centre of the centraliser 382 and beyond the nozzle 316 is an elongate plastics shaft 388 arranged concentrically with the through aperture 372. A flared deflector 328 is integrally formed with the front end of the shaft 388.

The shaft 388 has a central bore, which receives the discharge electrode wire 332. The discharge electrode wire 332 protrudes slightly beyond the forward end 390 of the shaft 388 remote from the centraliser 382. The rear end of the discharge electrode wire 332 passes internally through the centraliser 382 and terminates slightly proud of the rear face 392 of the centraliser 382 to form a contact 394. Thus, when the spacing sleeve 330 is correctly connected to the body 312, the discharge electrode wire 332 makes an electrical contact with an output 398 of the power supply.

A counter electrode wire 300 passes through a channel 301 in the spacing sleeve 330 extending parallel to the longitudinal axis of the spacer sleeve 330, and makes electrical contact at its front end with the counter electrode 360 and at its rear end to a ground terminal 304 of the power supply located in the body 312 of the gun 310.

Thus, by having the discharge and counter electrode contacts (394 and 304) at different radial positions, it is possible to ensure that the electrodes can only be connected the correct way. Also, if the gun 310 is used in conjunction with a conventional spacer-nozzle (i.e. without a forward-mounted counter electrode), then only the discharge electrode wire will make contact with the power supply.

In use, the discharge electrode 332 is electrically biased with respect to the counter electrode 360 using a power supply located within the body of the apparatus.

Figure 10:
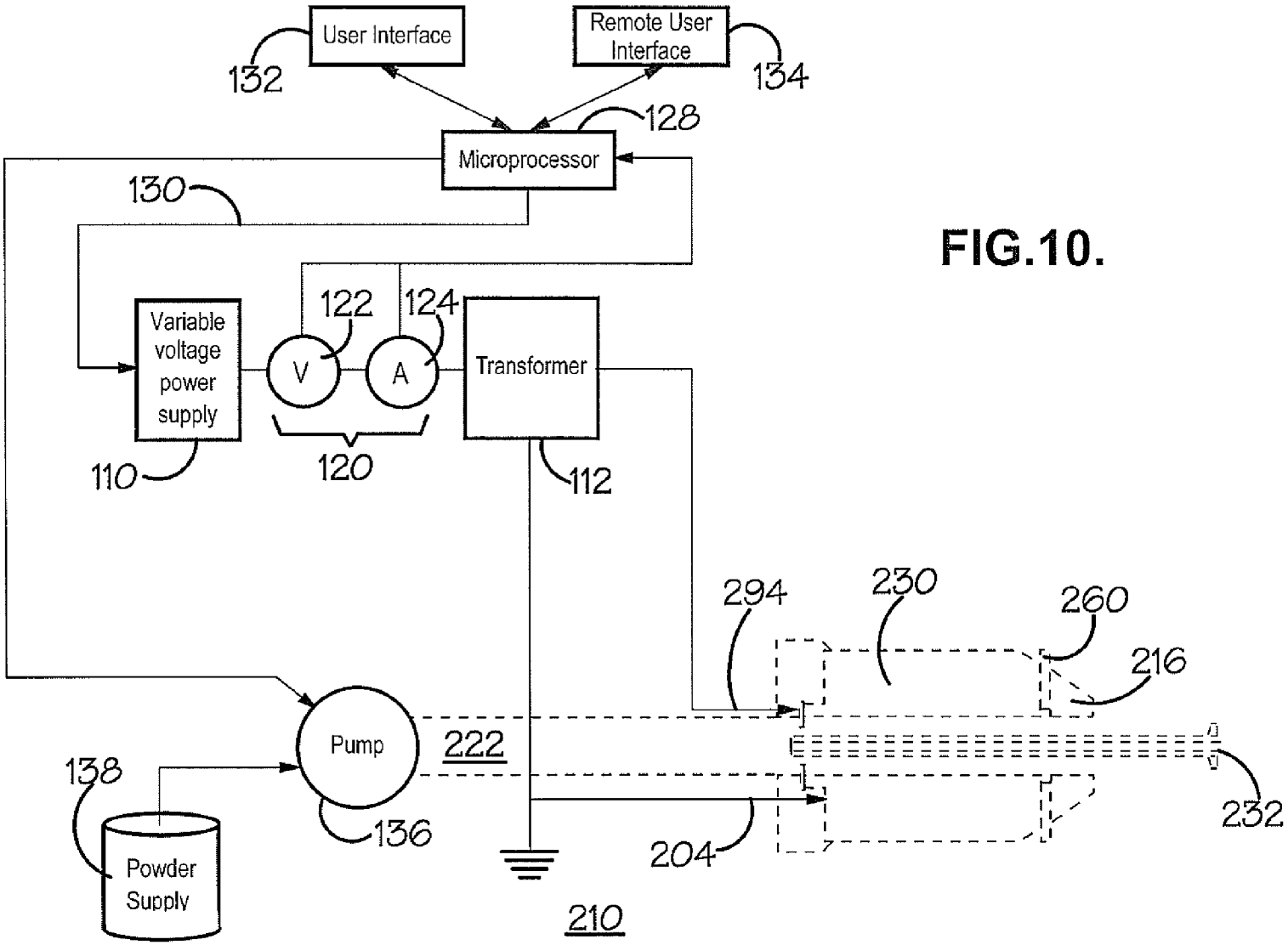
FIG. 10 is a schematic control circuit for the electrostatic powder spray coating gun of FIGS. 6 to 9.

FIG. 10 is a schematic of an alternative control and feedback system for the electrostatic powder spray coating gun of FIGS. 6 to 9. A variable voltage power supply 110 is connected to a step-up transformer 112 for converting an AC mains electricity supply (e.g. 230V, 50 Hz or 120V, 60 Hz) into a high tension or ultra-high tension (100-200 kV) supply at the discharge electrode contact 294.

The power supplied to the discharge electrode 232 is controlled by adjusting the variable voltage power supply 110.

A power sensing circuit 120 is also provided to monitor the discharge voltage and current indirectly. A voltmeter 122 and an ammeter 124, respectively, monitor the load drawn by the transformer, which is assumed to vary as a function of the load at the discharge 232 or counter electrode 260.

The voltmeter 122 and ammeter 124 readings are fed 126 to a microprocessor 128 (via appropriate analogue to digital converters, if necessary) which monitors and logs the respective readings. If the measured voltage or current moves outside specified ranges, then the microprocessor outputs a signal 130 to adjust the variable voltage power supply 110 to bring the voltage and/or current at the discharge electrode 260 back within the specified range.

In use, the power sensing and power control circuits operate as follows:

The discharge voltage and current are both limited to predetermined maximum values. The discharge voltage will operate at the maximum predetermined value until the maximum value of discharge current is reached. If the discharge current tries to exceed this maximum value the discharge voltage and current are both reduced proportionately as an inverse ratio of the output load. It can be assumed that the output load is the resistance of the air between the discharge electrode and an earthed object or counter electrode.

Since the distance between the discharge and counter electrodes is substantially fixed, variations in discharge load can be attributed to variations in powder throughput, atmospheric conditions or the gun closely approaching a grounded workpiece.

Where a fixed counter electrode is not used, i.e. where the workpiece, rather than the counter electrode is earthed, the greater the distance between the discharge electrode and the workpiece, the higher will be the resistance of the air and the lower will be the load and therefore the discharge current. The closer the distance between the discharge electrode and the workpiece, the lower will be the resistance of the air and the higher will be the load and therefore the discharge current. The controlled reduction of output voltage and current when the maximum predetermined current is exceeded is achieved by reducing the voltage of the low voltage supply to the high voltage generator.

The control circuit provides a variable voltage power supply that is controlled by a micro-controller. This power supply is fed to a high voltage generator assembly (HVGA) which in turn steps the voltage up by a fixed ratio to generate the high voltage at the gun. The HVGA comprises a circuit, a step-up transformer and a multi-stage voltage multiplier to convert a 12V DC input to a (+ or −) 80 kV DC output voltage. (A 10-stage voltage multiplier is preferred over a 12-stage one as it gives more clearance and therefore reduces the likelihood of electrical breakdown).

If the HVGA in the gun is assumed perfect with no losses and the step up ratio is fixed, the actual gun voltage is calculated by the micro-controller by multiplying the assumed step up ratio of the HVGA by the controlled power supply voltage.

The current load is measured on the positive input side of the HVGA by a dedicated analogue circuit. This circuit measures the voltage dropped across a small ohmic value resistor and translates this measurement into a 0 to 5 volt ground referenced signal. The frequency response of this analogue circuit is sufficiently fast to perform real time current control of the power supply. When the micro-controller measures the input current to the HVGA it can determine the effective load on the high voltage side. This is done by dividing the calibrated measured current on the input side of the HVGA by the assumed fixed step up ratio of the HVGA.

The actual amount of input voltage reduction or fold back when the predetermined output current is exceeded is configurable either by calculation by the microprocessor or by look up tables programmed into the system. This means that the fold back slope or gradient may be altered as necessary.

With the addition of the counter electrode to the spray gun in close proximity to the discharge electrode of the high voltage gun, and it being physically near to the output of the gun the near field created, causes the HVGA to operate as a high voltage proportional energy source, where the energy is proportional to the load resistance. Furthermore, there is now no immediate electrical interaction with the target being sprayed. In the event of the gun becoming too near to the target the gun current tries to increase, this is sensed by the micro-controller, and the output voltage of the controlled power supply is reduced to maintain the proportional energy of the gun. When the gun voltage is reduced to a level where spraying is not adequately possible, the gun current and voltage is further reduced to prevent any arcing between the gun electrode and the target being sprayed. This mode of reduced current and voltage is a purely safety operating mode and normal powder spraying would not be possible when the target work piece and gun are in close proximity.

The same control effects can be achieved using conventional analogue circuits. This is also achieved by measuring the voltage dropped across a small ohmic value resistor and using operational amplifiers to provide negative feedback relative to the output current and control an output transistor which provides the low voltage supply to the high voltage generator.

In other words, the control circuit provides a means to control the discharge energy (i.e. the voltage and current) in proportion to the proximity of the discharge electrode and counter electrode or earth (e.g. a grounded workpiece).

A user interface 132 is provided so that an operator can specify the mode of operation and/or the process parameters, e.g. the maximum predetermined discharge current and voltage. The user interface comprises a built-in database of customisable pre-sets so that the user can quickly select the operating parameters for a particular task. The user interface comprises an input device, such as a touch screen and/or a keyboard and/or a pointing device (e.g. a mouse) and a visual display unit. A portable, remote user interface 134 is also provided that is wirelessly connected to the microprocessor.

In addition, the microprocessor 128 also controls other aspects of the gun's operation, such as the powder throughput. The microprocessor is, accordingly, operatively connected to control a pump 136 so that the delivery of powder from a powder supply 138 to the nozzle 216 of the gun 210 can be controlled.

The microprocessor is also configured to "recognise" which particular type of spacing sleeve 230 and nozzle 216 attached to the gun 210. For example, if the spacer-nozzle arrangement described with reference to FIGS. 6 to 8 is connected, when the gun is activated, the microprocessor will immediately act to reduce the applied voltage and/or current. However, if a counter electrode arrangement such as that shown in FIGS. 2 and 4 is used, then when the gun is activated, the microprocessor would not immediately act to reduce the applied voltage and/or current (unless the discharge electrode is close to a grounded object).

The microprocessor 128 is thus configured to recognise different setups automatically and to limit the available modes of operation and/or the process parameters accordingly. For example, if a counter electrode arrangement such as that shown in FIGS. 6 to 8 is used, then the maximum current and/or voltage will be limited to prevent sparking, whereas with more spaced-apart electrodes, much higher discharge voltages can be used. Additionally, if no counter electrode is used, then the feedback will need to come from readings taken between the discharge electrode and the workpiece etc.

The microprocessor also has built in safety functions, such as spark prevention. By constantly monitoring the discharge current and voltage, a rapid increase in discharge current accompanied by a rapid decrease in discharge voltage can be "interpreted" as a short circuit or a spark and a shut-down command can be sent to the power control circuit 114 to temporarily reduce and/or switch off the power supply 110.

Figure 11:
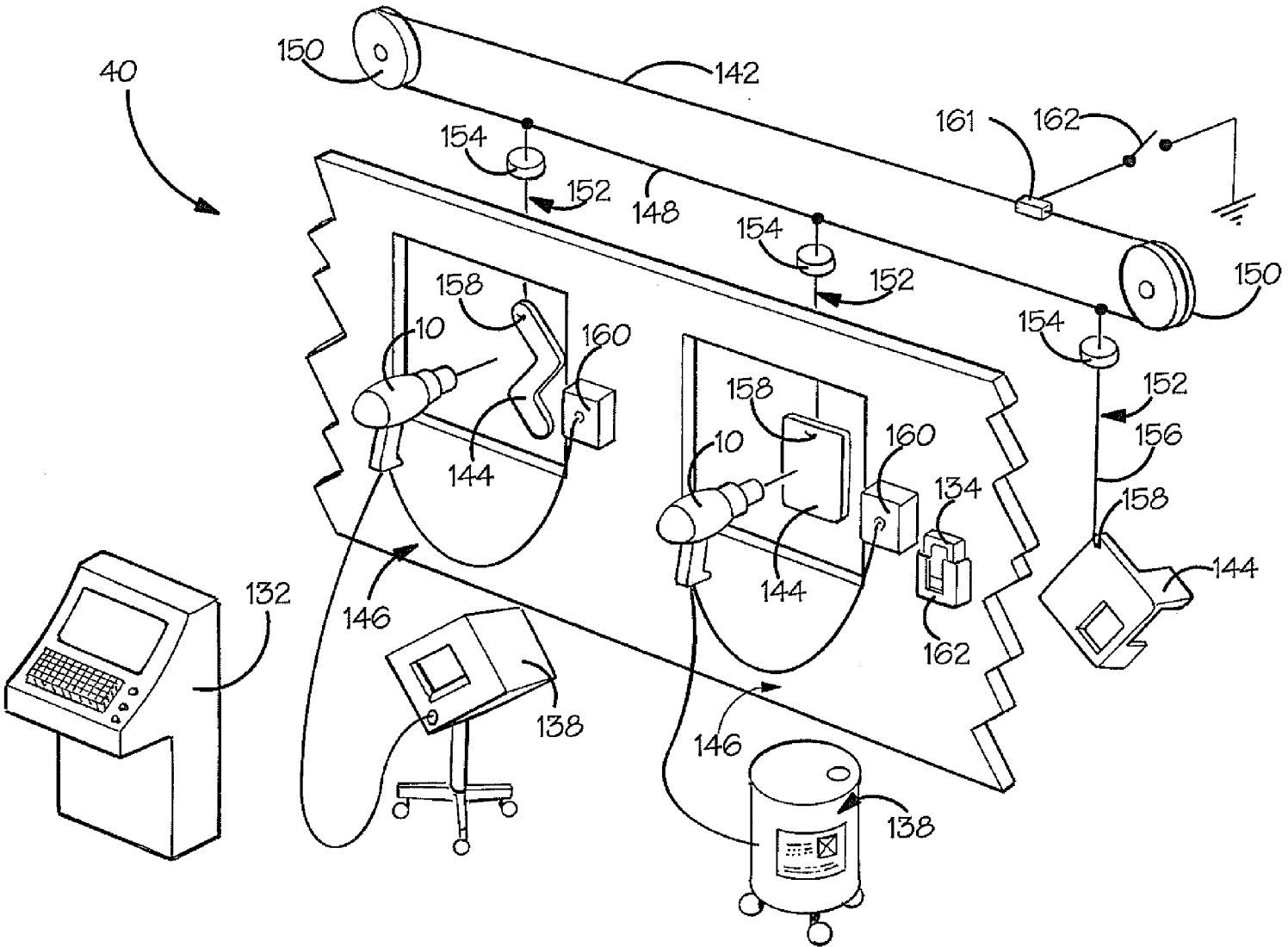
FIG. 11 is a perspective view of part of an electrostatic powder spray coating production line incorporating a plurality of guns in accordance with the invention.

Finally, FIG. 11 shows a plurality of electrostatic powder spray guns 210 (as described in relation to FIGS. 6 to 10) ready for use on a production line 140.

The production line 140 comprises an overhead conveyor system 142 for conveying workpieces 144 past a series of work stations 146, each having an electrostatic powder spray coating gun 210 associated therewith. The conveyer system 142 comprises an overhead cable 148 that is passed around spaced apart pulleys 150 and whose ends are connected together to form a continuous loop. Rotation of the pulleys 150 causes the cable 148 to move past each work station 146 in turn. Connected to and hanging from the cable 148 are a number of suspension means 152. The suspension means 152 each comprise a mechanically driven swivel 154 from which an elongate wire 156 hangs having a hook 158 at the free end thereof. Thus, workpieces 144 can be hooked onto the suspension means 152 and indexed from one work station 146 to the next and/or rotated so that they can be sequentially coated from each side.

The hook 158, swivel 154 and cable 148 are all manufactured of metal to ensure earth continuity.

A primary user interface 132 allows an operator to set the operating parameters for each gun 10. The primary user interface 132 connects via concealed wires to a series of connector boxes 160. Thus, in use, each operator can simply plug his gun 10 into the connector box 160 to receive power and control inputs from the microprocessor in the primary user interface 132.

In the embodiment shown in FIG. 11, the two guns 10 are set up to perform different coating operations, namely priming and top coating. Thus, the guns 10 are connected to different powder supplies 138 and are programmed with different operating parameters from the user interface 132.

A hand-held portable computer 134, with a wireless link to the primary controller 132, is provided so that operators can inspect the workpiece 144 and make manual adjustments to the gun's process parameters without having to leave their workstations 146. A cradle 160 is provided to conveniently store the portable computer 134 when it is not being used.

The invention is not limited to the details of the foregoing embodiments. In particular, the guns need not be hand-held devices—they could equally be robot mounted or even mounted on fixed stands past which the workpieces move. The production line shown in FIG. 10 need not be so sophisticated—it could simply comprise a partially enclosed booth at which an operator stands and manually manipulates the item to be coated.

The counter electrode of the invention could be supplied as an "add on" to a conventional nozzle with an external earth connection in the form of a flying lead to an earth point near the back of the spray gun (as in current practice), or it could be built into a nozzle with an earth connection being made automatically when the nozzle is fitted to the spray gun. The earth electrode contacts could take the form of an earthed metal rod or single point electrode or an annular array of multiple earthed pins as previously described or could take the form of a castellated metal disk where the edges of the castellations form points which act as individual electrodes.

If a conventional nozzle were fitted without the counter electrode, the control circuit of the invention would preferably detect whether the counter electrode is fitted when the spray gun is energized by monitoring whether a low voltage and current is in use automatically on "switch on" or whether the normal high voltage is being discharged. If no counter electrode is fitted, the electrostatic output would be either disabled or automatically switched to conventional charge

What is claimed is:

1. A powder spray coating discharge assembly for connection to an electrostatic spray coating gun, the electrostatic spray coating gun having a gun body, means for connecting to a supply of coating powder, means for supplying a voltage at a first, non-ground potential to a first electrical connection and means for connecting a second electrical connection to ground potential, the powder spray coating discharge assembly comprising:

an electrically insulating spacer having means for connecting to the gun body, and a conduit for the passage of coating powder;

a nozzle having means for connecting to the electrically insulating spacer and having an aperture for the discharge of coating powder;

a discharge electrode located downstream of the discharge aperture of the nozzle and electrically connectable to the first electrical connection; and a counter electrode located between the discharge electrode and the portion of the electrically insulating spacer which is configured to engage the gun body, the counter electrode being electrically connectable to the second electrical connection.

2. The power spray coating discharge assembly of claim 1, wherein the counter electrode is interposed between the nozzle and the spacer.

3. The power spray coating discharge assembly of claim 1, wherein the counter electrode comprises an annular metal plate having one or more protuberances thereon.

4. The power spray coating discharge assembly of claim 1, wherein the nozzle further comprises a deflector.

5. The power spray coating discharge assembly of claim 1, further comprising a power supply for electrically biasing the discharge electrode with respect to the counter electrode.

6. The power spray coating discharge assembly of claim 1, further comprising a power supply for electrically biasing the discharge electrode with respect to the counter electrode and a control circuit for controlling the voltage and/or current applied to the discharge and/or counter electrode.

7. The power spray coating discharge assembly of claim 1, further comprising a power supply for electrically biasing the discharge electrode with respect to the counter electrode, a control circuit for controlling the voltage and/or current applied to the discharge and/or counter electrode and a user interface, which user interface comprises any one or more of the group comprising an input device, a visual display unit, a database of customisable pre-set modes of operation and/or process parameters, and a wireless interface operatively connected to the microprocessor.

8. The power spray coating discharge assembly of claim 1, further comprising a power supply for electrically biasing the discharge electrode with respect to the counter electrode, a control circuit for controlling the voltage and/or current applied to the discharge and/or counter electrode and a user interface, which user interface comprises any one or more of the group comprising an input device, a visual display unit, a database of customisable pre-set modes of operation and/or process parameters, and a wireless interface operatively connected to the microprocessor wherein the control circuit comprises a power control circuit.

9. The power spray coating discharge assembly of claim 1, further comprising a power supply for electrically biasing the discharge electrode with respect to the counter electrode, a control circuit for controlling the voltage and/or current applied to the discharge and/or counter electrode and a user interface, which user interface comprises any one or more of the group comprising an input device, a visual display unit, a database of customisable pre-set modes of operation and/or process parameters, and a wireless interface operatively connected to the microprocessor wherein the control circuit comprises a power sensing circuit.

10. The power spray coating discharge assembly of claim 1, further comprising a power supply for electrically biasing the discharge electrode with respect to the counter electrode, a control circuit for controlling the voltage and/or current applied to the discharge and/or counter electrode and a user interface, which user interface comprises any one or more of the group comprising an input device, a visual display unit, a database of customisable pre-set modes of operation and/or process parameters, and a wireless interface operatively connected to the microprocessor, wherein the control circuit comprises a microprocessor that is programmed to monitor and/or log the sensed voltage and/or current at the discharge and/or counter electrode and/or to control the power control circuit.

11. The power spray coating discharge assembly of claim 1, further comprising a power supply for electrically biasing the discharge electrode with respect to the counter electrode, a control circuit for controlling the voltage and/or current applied to the discharge and/or counter electrode and a user interface, which user interface comprises any one or more of the group comprising an input device, a visual display unit, a database of customisable pre-set modes of operation and/or process parameters, and a wireless interface operatively connected to the microprocessor wherein the control circuit comprises a microprocessor that is programmed to monitor and/or log the sensed voltage and/or current at the discharge and/or counter electrode and/or to control the power control circuit and wherein the power control circuit can be programmed to operate in any one or more of the operating modes of the group comprising: constant voltage control, constant current control, fixed voltage control, fixed current control and constant energy control.

12. The power spray coating discharge assembly of claim 1, further comprising a powder delivery means.

13. The power spray coating discharge assembly of claim 1, further comprising a powder delivery means and a microprocessor adapted to control the powder delivery means.

14. The power spray coating discharge assembly of claim 1, further comprising a microprocessor programmed to constantly monitor the discharge current and/or voltage and control the power supply circuit to reduce and/or switch off the voltage/current at the discharge electrode when a sudden decrease in discharge voltage and/or a sudden increase in discharge current is detected at the discharge electrode.

15. The power spray coating discharge assembly of claim 1, wherein the maximum voltage that can be applied to the discharge and/or counter electrode is limited to any one of the group comprising 100 kV, 70 kV and 40 kV.

16. The power spray coating discharge assembly of claim 1, wherein the maximum current that can be applied to the discharge and/or counter electrode is substantially any one of the group comprising 100 μA, 70 μA and 20 μA.

17. A powder spray coating discharge assembly for connection to an electrostatic spray coating gun, the electrostatic spray coating gun having a gun body, means for connecting to a supply of coating powder, means for supplying a voltage at a first, non-ground potential to a first electrical connection and means for connecting a second electrical connection to ground potential, the powder spray coating discharge assembly comprising:

an electrically insulating spacer having means for connecting to the gun body, and a conduit for the passage of coating powder;

a nozzle having means for connecting to the electrically insulating spacer and having an aperture for the discharge of coating powder;

a discharge electrode located downstream of the discharge aperture of the nozzle and electrically connectable to the first electrical connection; and a counter electrode located externally of the electrically insulating spacer, the counter electrode being electrically connectable to the second electrical connection; wherein the means for supplying a voltage at the first, non-ground potential comprises a control circuit arranged to automatically adjust the discharge voltage and current at the first electrical connection as a function of any one or more of the group comprising: the distance between the discharge electrode and the counter electrode, the powder throughput, the powder type, the electrode condition and atmospheric conditions.

18. A powder spray coating discharge assembly for connection to an electrostatic spray coating gun, the electrostatic spray coating gun having a gun body, means for connecting to a supply of coating powder, means for supplying a voltage at a first, non-ground potential to a first electrical connection and means for connecting a second electrical connection to ground potential, the powder spray coating discharge assembly comprising:

an electrically insulating spacer having means for connecting to the gun body, and a conduit for the passage of coating powder;

a nozzle having means for connecting to the electrically insulating spacer and having an aperture for the discharge of coating powder;

a discharge electrode located downstream of the discharge aperture of the nozzle and electrically connectable to the first electrical connection; and a counter electrode located externally of the electrically insulating spacer, the counter electrode being electrically connectable to the second electrical connection;

the means for supplying the voltage comprising:

a variable voltage power supply having an input connected to an electrical power source, an output connected to each of the first and second electrical connections, a control circuit for controlling the variable voltage power supply and means for sensing the load between the discharge electrode and the counter electrode, wherein the control circuit adjusting the variable voltage power supply to reduce the voltage and current as a function of a sensed increase in said load, or vice-versa.

19. The powder spray coating discharge assembly of claim 18, wherein the means for sensing the load comprises, on the positive input side of the gun transformer, a circuit arranged to measure the voltage drop across a resistor and to translate this measurement into a ground referenced signal.

* * * * *